US006942067B2

(12) United States Patent
Cholinski et al.

(10) Patent No.: US 6,942,067 B2
(45) Date of Patent: Sep. 13, 2005

(54) PORTABLE EMERGENCY DRIVE FOR AN ELEVATOR

(75) Inventors: Andrzej Cholinski, Ebikon (CH); Heinrich Küttel, Weggis (CH)

(73) Assignee: Inventio AG, Hergiswil (CH)

( * ) Notice: Subject to any disclaimer, the term of this patent is extended or adjusted under 35 U.S.C. 154(b) by 187 days.

(21) Appl. No.: 10/364,805

(22) Filed: Feb. 11, 2003

(65) Prior Publication Data

US 2003/0155186 A1 Aug. 21, 2003

(30) Foreign Application Priority Data

Feb. 18, 2002 (EP) ..... 02405122

(51) Int. Cl.[7] ..... B66B 11/08

(52) U.S. Cl. ..... 187/258; 187/290; 187/314; 187/900

(58) Field of Search ..... 187/255–258, 187/276, 277, 263, 290, 298, 306, 314, 349, 900

(56) References Cited

U.S. PATENT DOCUMENTS

| | | | | | |
|---|---|---|---|---|---|
| 780,711 | A | * | 1/1905 | Donnell | 182/141 |
| 2,122,908 | A | * | 7/1938 | Collins | 187/406 |
| 3,162,793 | A | * | 12/1964 | Mason | 318/8 |
| 3,658,156 | A | * | 4/1972 | Abbott | 187/290 |
| 4,220,222 | A | * | 9/1980 | Kamaike et al. | 187/290 |
| 4,434,875 | A | * | 3/1984 | Scarzella | 187/285 |
| 4,533,021 | A | * | 8/1985 | Perez de la Orden | 187/290 |
| 5,769,183 | A | * | 6/1998 | Richter et al. | 187/249 |

FOREIGN PATENT DOCUMENTS

| | | | | | |
|---|---|---|---|---|---|
| DE | 197 25 068 | A1 | | 12/1998 | |
| EP | 0468 168 | B1 | | 8/1994 | |
| EP | 0733577 | A | | 9/1996 | |
| EP | 0 733 577 | A2 | | 9/1996 | |
| FR | 2129891 | | | 11/1972 | |
| JP | 54042754 | A | * | 4/1979 | B66B/5/02 |
| JP | 54065954 | A | * | 5/1979 | B66B/5/02 |
| JP | 54129637 | A | * | 10/1979 | B66B/5/02 |

OTHER PUBLICATIONS

Patent Abstracts of Japan, No. 10017245 A, "Hoist For Elevator", Jan. 20, 1998, Mitsubishi Electric Corp.
Patent Abstracts of Japan, No. 09263367 A, "Elevator Winding Machine", Oct. 7, 1997, Mitsubishi Electric Corp.
Patent Abstracts of Japan, No. 2000063063 A, "Elevator Hoisting Winch", Feb. 29, 2000, Hitachi Ltd.

* cited by examiner

*Primary Examiner*—Jonathan Salata
(74) *Attorney, Agent, or Firm*—Schweitzer Cornman Gross & Bondell LLP

(57) ABSTRACT

An emergency drive is a toothed element such as a gear rim, is arranged on a traction sheave of an elevator drive. During emergency operation, the gear rim is driven by means of a pinion of an auxiliary engine. The engine is installed on the elevator drive only during an emergency operation. After emergency operation, the engine is removed from the drive unit. The gear rim may be composed of several layers of interlocked segments. The layers are mutually shifted in a circumferential direction. Each segment consists of laminated/interlocked sheet metal segments, which are, as mass-produced goods, cheaply producible through cutting and punching procedures.

7 Claims, 5 Drawing Sheets

PORTABLE EMERGENCY DRIVE FOR AN ELEVATOR

The invention concerns an emergency drive for an elevator with an elevator car and a counterweight moving drive unit consisting of engine and traction sheave, through which cables are driven and such cables are connected to the elevator car and the counterweight, whereby during the emergency operation, the emergency drive affects the drive unit.

BACKGROUND OF THE INVENTION

A gearless drive machine for elevators is known from patent document EP 0,468,168 B1. In that gearless drive machine for elevators, a machine frame carries a bearing block and a shield block. A main shaft is mounted at two points on the output side by means of a free bearing arranged on the bearing block and by means of a fixed bearing arranged on the shield block. A traction sheave with a brake disc is provided between the bearing points. The traction sheave is firmly connected to the main shaft by means of a first clamping unit. The bearing arrangement of the traction sheave on both sides permits large radial loads during small deformations of the main shaft. A hoist motor fed with alternating-current voltage consists of a stator and of a rotor with a rotor hub, which can be pushed onto the main shaft. At the drive-side end of the main shaft, a second clamping unit provides a fixed connection between the main shaft and the rotor hub. At the machine frame, which carries a bearing block and a shield block, is also a counter-roller support with a counter-roller which serves to keep a given cable-line spacing through the elevator car and counterweight as well as through the cable guide.

A hand drive with a worm gear unit, coupled to the main shaft, makes possible, in case of voltage loss, a manual moving of the main shaft.

A disadvantage of such a known installation lies in the fact that a large expenditure of energy is necessary for moving the main shaft. In addition, such types of emergency drives are very expensive.

BRIEF DESCRIPTION OF THE INVENTION

The invention provides an attachable emergency drive for an elevator drive traction sheave, whereby the emergency drive is directly coupled to the traction sheave. The emergency drive includes a motor drive and a gear rim which is directly affixed to the traction sheave. In an emergency condition, the motor drive is mounted to the traction sheave drive unit, and is coupled to a power assembly.

The advantages obtained by the invention include that the heavy and expensive gear units previously used for each drive unit are replaced by a single compact drive, in each machine room. The drive is employed only when a drive unit is in an emergency operation condition. After the emergency operation, the drive is removed from the drive unit. A further benefit is the economical production of the gear rim, arranged on the traction sheave, whereby the toothed quadrants are constructed from laminated, interlocked sheet metal segments, which are cheaply producible by means of punching or cutting procedures.

BRIEF DESCRIPTION OF THE FIGURE

The invention is described in greater detail in the following description, in connection with the annexed figures, wherein.

DETAILED DESCRIPTION OF THE INVENTION

Figure 1:
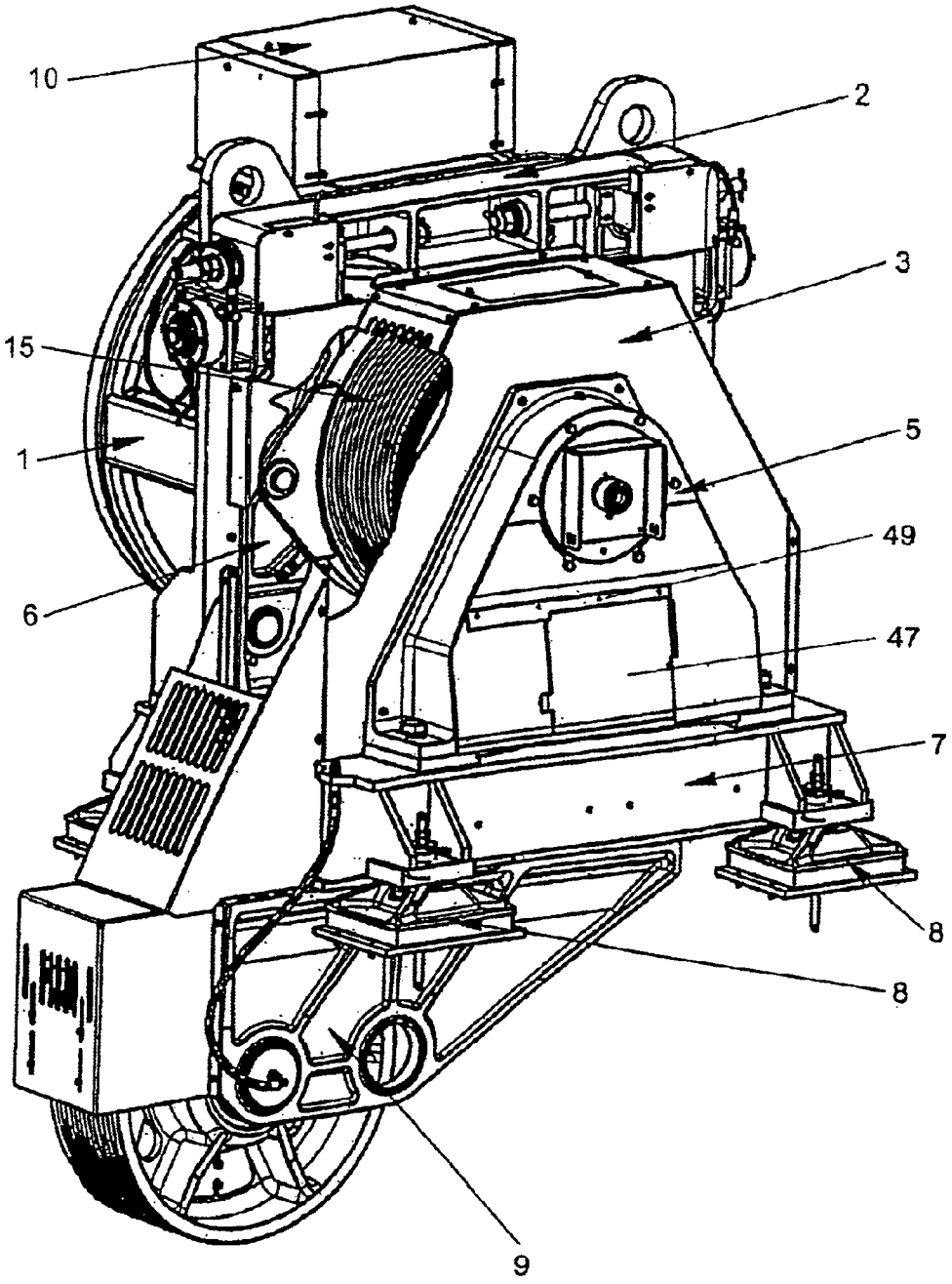
FIG. 1 is a view of a drive unit of the invention with a traction sheave.

FIG. 1 shows an assembled drive unit, essentially consisting of an engine 1, an engine stand 2 serving as an end shield, a bearing block 5 serving as a second end shield, a traction sheave 15 and a machine frame 7 with counter-roller support 9. Cables (not shown) are guided over the traction sheave 15; such cables are connected at a first end to an elevator car and at a second end to a counterweight. The stator of the electric drive 1 is bolted, by means of a flange, to the engine stand 2. The rotor of the electric drive 1 is connected to a free end of a shaft bearing the traction sheave 15; the shaft is mounted to the bearing block 5 and to the engine stand 2. The free shaft end extends beyond the engine stand 2. The traction sheave 15, which is visible through a broken-away section of cable protection casing 3, is mounted upon the engine stand 2 and bearing block 5 by means of the shaft. A brake 6 is arranged at the inside face of the engine stand 2 and is protected by the casing 3. Depending upon the structure of the drive unit, the brake 6 can also be positioned at the inside face of the bearing block 5.

The engine stand 2 and the bearing block 5 are arranged on the machine frame 7, which has at each of its corners an adjustable supporting element 8. The counterroller support 9 is arranged on the lower side of the machine frame 7. All electrical connections of the drive unit are in a terminal box 10. The traction sheave 15 is accessible from the outside, after opening a side plate 47.

Figure 2A:
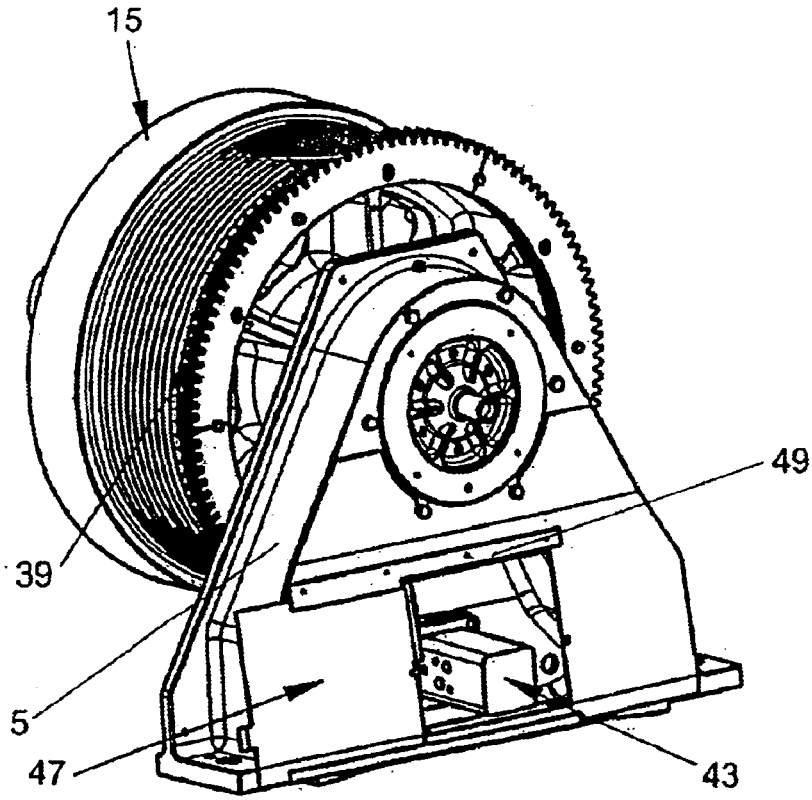
FIGS. 2*a* and 2*b* are views of the traction sheave with a gear rim.
Figure 2B:
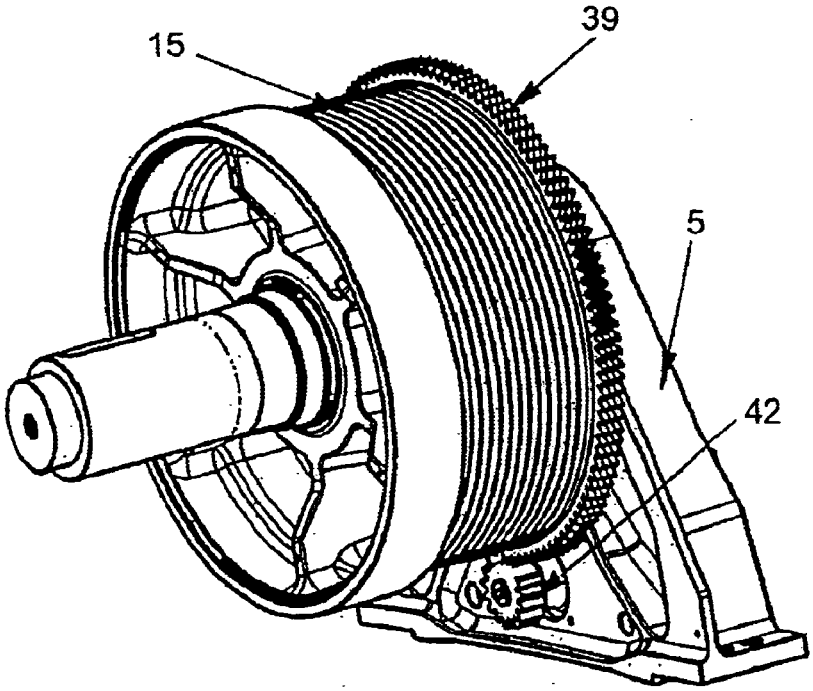
Figure 3:
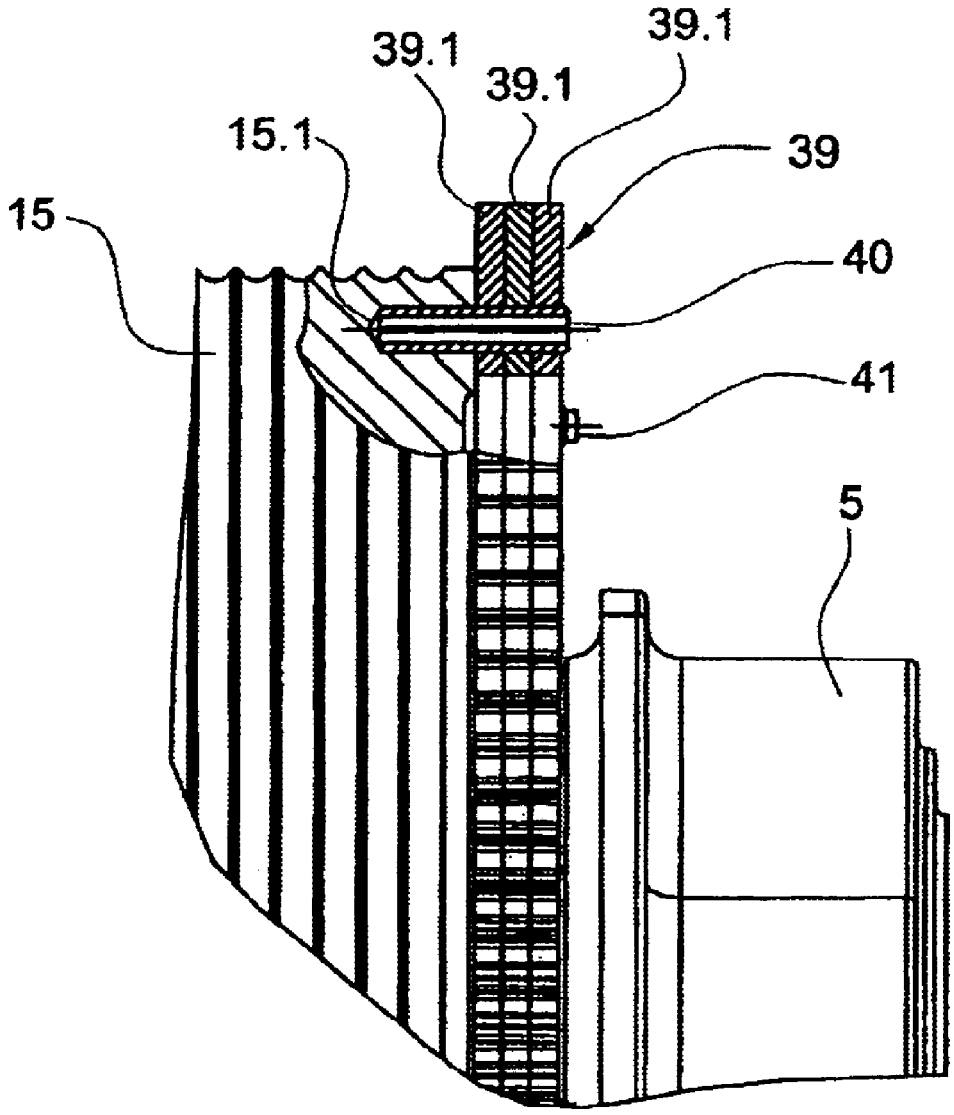
FIG. 3 is a detail view of the gear rim.
Figure 4A:
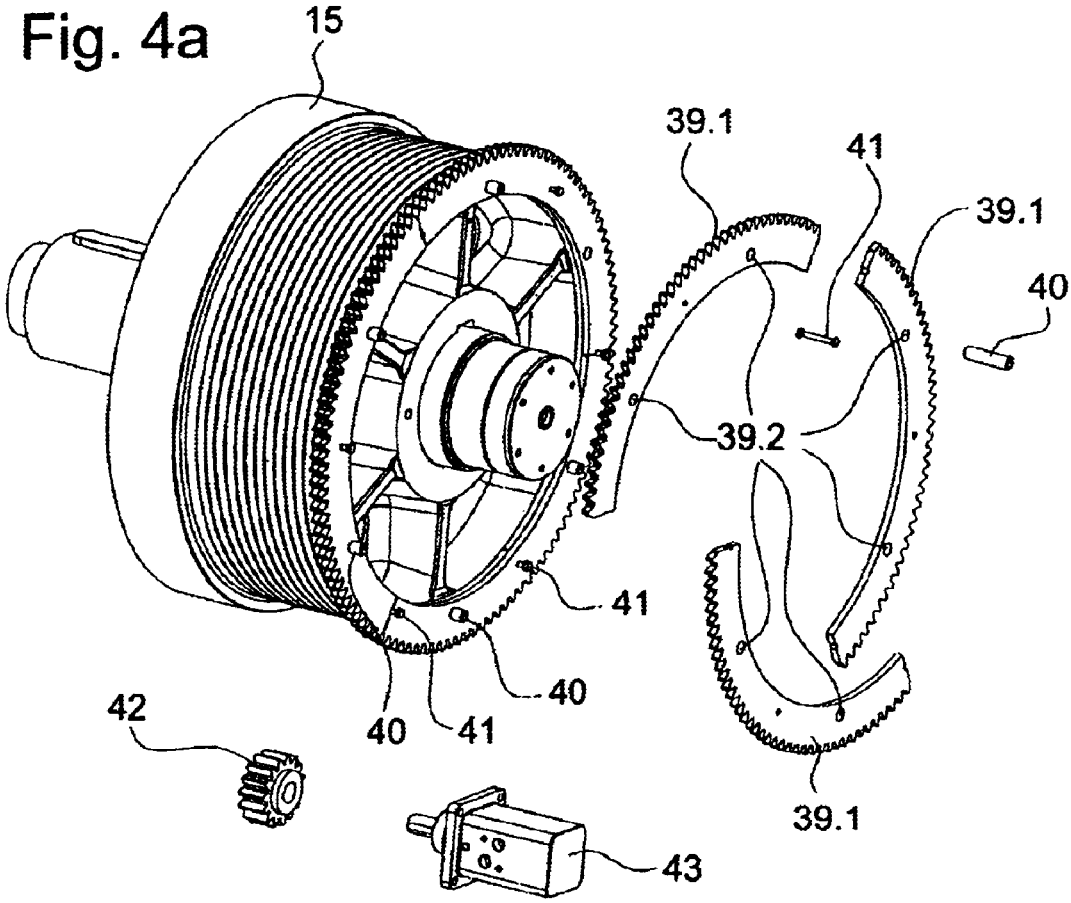
FIGS. 4*a* and 4*b* are exploded views of the traction sheave and associated bearing block of FIGS. 2*a* and 2*b*.
Figure 4B:
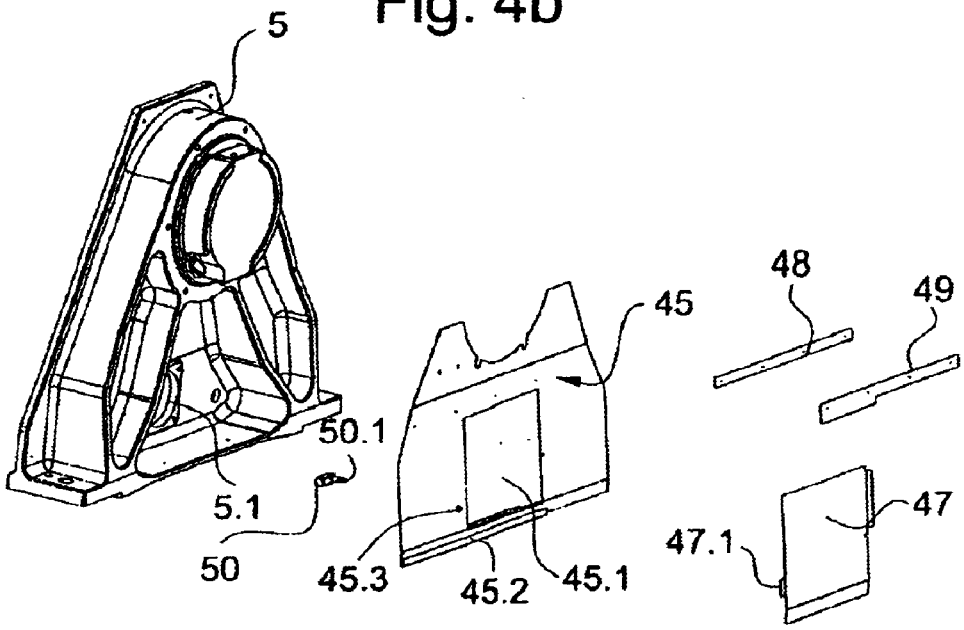
Figure 5B:
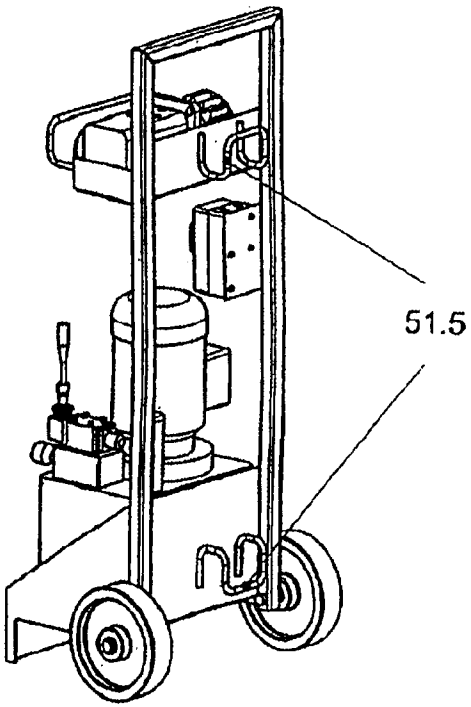
FIGS. 5*a* and 5*b* depict an auxiliary installation for the emergency drive.
Figure 5A:
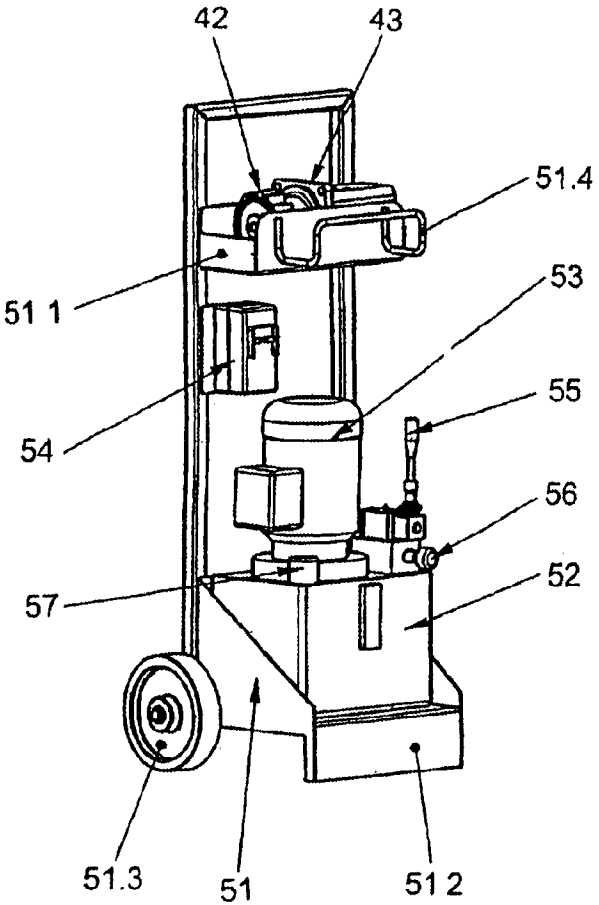

The construction of the emergency drive is described in more detail in FIGS. 2*a* to 4*b*, whereby in FIGS. 2*a* and 2*b* is to be seen an assembled view of the drive elements installed, and in FIGS. 4*a* and 4*b*, an exploded view of the elements. FIG. 3 shows details of a gear rim 39 arranged on the traction sheave 15 and FIGS. 5*a* and 5*b* show an auxiliary facility for the emergency drive.

In emergency operation, the traction sheave 15 is put into connection with a drive engine through a toothed element, such as gear rim 39. The gear rim 39 is composed of interlocked segments 39.1 which sit on the traction sheave 15 by means of tension pins 40 entering the rim holes 39.2 and in the appropriate drilled sheave holes 15.1. Screws 41, which are passed through the gear rim 39 and screwed into the traction sheave 15, hold the segments 39.1 together in the axial direction. Each segment 39.1 is composed of laminated, interlocked sheet metal segments, which are cheaply producible by means of punching or cutting procedures. The gear rim 39 is composed of several layers of interlocked segments 39.1, which are mutually shifted in the circumferential direction, whereby each segment 39.1 has at least two holes 39.2 for the tension pins 40, which are pressed into the holes 15.1 of the traction sheave 15.

The gear rim 39 is driven by means of a pinion 42, installed on the shaft of a hydraulic engine 43. The engine 43 is inserted, for that purpose, into an entrance hole 5.1 of the bearing block 5 and fastened with screws. The entrance hole 5.1 is located such that it is covered with an end cover 45. A mains-fed or battery-powered electric drive engine can be used, for example, instead of the hydraulic engine 43. Instead of a direct toothed coupling between the gear rim 39 and the pinion 42, a motor driven toothed belt transferring the motor power to an element in the form of a belt wheel instead of the gear rim 39, can be used, for example, whereby the toothed belt wheel is arranged, like the gear rim 39, about the circumference of the traction sheave 15.

The end cover 45 has an opening 45.1, which is closable with the sliding cover 47 guided along the guides 45.2, 48 and 49. Before the introduction of the hydraulic engine 43, the sliding cover 47 must be brought into an open position. In so doing, a safety switch 50, whose ram 50.1 protrudes through the hole 45.3 in the end cover 45, is depressed by an operating cam 47.1 on the cover 27, whereby a safety circuit is interrupted, so that operating the electric drive 1 is not possible during the emergency operation.

FIG. 5*a* and FIG. 5*b* show a mobile hydraulic assembly, which consists of a car 51 with a carrier 51.1 for a hydraulic engine 43, a carrier 51.2 for the acceptance of a hydraulic assembly 52, wheels 51.3, a handle 51.4 for carrying hydraulic tubes, as well as two further handles 51.5 for coiling an electrical cable for a pump engine 53. The hydraulic assembly 52 consists of a pump with pump engine 53, which can be switched on through an engine switch 54, as well as a distributing valve 55 for controlling the hydraulic engine 43. Further elements of the hydraulic assembly 52 are an adjustable safety valve 56 and an oil filter 57. For use in a machine room without an emergency power supply, a hand pump with hydraulic accumulator can be provided instead of the pump motor 53.

We claim:

1. An emergency drive for an elevator having an elevator car and counterweight-moving drive unit comprising an engine and a traction sheave through which cables connected with the elevator car and the counterweight are driven, the emergency drive comprising a portable emergency drive engine having a drive element for direct coupling to the traction sheave and means associated with the drive unit for mounting the drive engine to the drive unit during an emergency condition whereby the drive element is directly coupled to the traction sheave.

2. The emergency drive according to claim 1, wherein the drive element is coupled to the traction sheave at a circumference thereof.

3. The emergency drive according to claim 1 or 2, wherein the drive element comprises a toothed element affixed to the traction sheave and a mating toothed drive loop.

4. The emergency drive according to claim 3, wherein the toothed element is a gear rim and the toothed drive loop includes a mating pinion mounted to the emergency drive engine.

5. The emergency drive according to claim 4, wherein the gear rim is of a stacked construction.

6. The emergency drive according to claim 5, wherein the gear rim is formed from a plurality of layers of interlocked segments which are mutually shifted in a circumferential direction, whereby each segment is developed from laminated, interlocked sheet metal segments.

7. The emergency drive according to claim 6, further comprising tension pins press fit into corresponding holes in the traction sheave and wherein each segment has holes for the acceptance tension pins.

* * * * *